US009908025B2

(12) United States Patent
Diz

(10) Patent No.: US 9,908,025 B2
(45) Date of Patent: Mar. 6, 2018

(54) PORTABLE GUIDING DEVICE FOR THE PRACTICE OF GOLF

(71) Applicant: Alejandro Jesus Diz, Capital Federal Bs As (AR)

(72) Inventor: Alejandro Jesus Diz, Capital Federal Bs As (AR)

( * ) Notice: Subject to any disclaimer, the term of this patent is extended or adjusted under 35 U.S.C. 154(b) by 0 days.

(21) Appl. No.: 15/157,590

(22) Filed: May 18, 2016

(65) Prior Publication Data

US 2016/0339322 A1 Nov. 24, 2016

(30) Foreign Application Priority Data

May 19, 2015 (AR) ..... P150101555

(51) Int. Cl.

| | |
|---|---|
| ***A63B 69/36*** | (2006.01) |
| ***A63B 69/00*** | (2006.01) |
| *A63B 71/06* | (2006.01) |

(52) U.S. Cl.

CPC ..... *A63B 69/3676* (2013.01); *A63B 69/0059* (2013.01); *A63B 69/3608* (2013.01); *A63B 2071/0655* (2013.01); *A63B 2209/10* (2013.01); *A63B 2220/802* (2013.01); *A63B 2220/805* (2013.01); *A63B 2225/09* (2013.01); *A63B 2225/50* (2013.01)

(58) Field of Classification Search

CPC ..... A63B 69/3676

See application file for complete search history.

(56) References Cited

U.S. PATENT DOCUMENTS

| | | | | |
|---|---|---|---|---|
| 5,785,603 A * | 7/1998 | Lazier | A63B 69/3608 | 273/DIG. 30 |
| 2008/0176665 A1* | 7/2008 | Snyders | A63B 69/0059 | 473/216 |
| 2011/0201438 A1* | 8/2011 | Butts | A63B 69/3608 | 473/215 |

* cited by examiner

*Primary Examiner* — Michael Dennis

(74) *Attorney, Agent, or Firm* — Womble Bond Dickinson (US) LLP

(57) ABSTRACT

Portable guiding device for the practice of golf comprising a first fastening module, rigid or semi-rigid, with an inverted U shape, which is attached to the user's belt. Said first fastening module comprises attachment methods to a second arm module, which in turn comprises a retractable extendible system that is placed in a mouth of said second arm module. Said retractable arm, in turn, comprises a series of telescopic sub-arms that may be manually extended or retracted, depending on the user's needs, and concludes in a distal end which is placed in the mouth of an objective module, which is made of a soft material. The second arm module allows for different adjustment and angle degree variations.

3 Claims, 12 Drawing Sheets

PORTABLE GUIDING DEVICE FOR THE PRACTICE OF GOLF

TECHNICAL FIELD

The present application is for a portable guiding device to be used in the practice of golf, and more precisely, to help the golf player practice the stroke commonly referred to as "putting" stroke.

BACKGROUND OF THE INVENTION

Golf is a sport activity in continuous and sustained growth, with 50,000,000 amateur players around the world, according to 2014 statistics.

The traditional golf round consists of 18 holes, each of which vary in difficulty and length. The number of strokes in each round is divided between those called "fairway strokes", which are made along the fairway until you get to the green where the hole is located; and those called "putting strokes", which are strokes made in the green. The best scores are achieved by reducing the total number of strokes per round, and putting strokes are key when trying to accomplish this. Nevertheless, a bad putting performance is very common not only in amateur players but also in some professional players.

Amateur golfers do not tend to take putting lessons. Those areas in Golf Clubs and Driving Ranges where one can practice putting are not usually very busy, as opposed to those areas where general golf practice takes place.

It is striking that even though a bad putting performance is the cause of most amateur players' frustrations and the reason behind poor final scores, little attention is paid to putting practice as opposed to the other aspects of the game.

Putting practice without an adequate technique or a repetitive and consistent mechanism can turn out to be tedious, boring and frustrating, which definitely makes players spend more time focusing on other aspects of the game where improvement can be perceived through practice.

Notwithstanding the aforementioned, for a while innovators have been trying to improve players' performances through the use of their inventions. Most of them aim to improve golf players' swing, while some of them aim to solve the same problem this invention aims to solve, the putting stroke.

One of the first known related art devices, English patent GB175197A, dates back to 1921 and consists of a mechanical device which aims to teach the right way to make a putting stroke. A heavy and hard-to-assemble device, whose objective is to "guide" the golf club in order to achieve a successful stroke. The suggested solution is unfeasible and discouraging for any player.

A group of known related art documents suggests using a type of small or even portable external guide to help the player achieve his goal. Some of those external guides are Spanish documents ES 1 078 831 U, English patent GB 1 385 004, U.S. Pat. No. 3,844,569 and U.S. Pat. No. 3,857,570, U.S. Pat. No. 4,927,153, U.S. Pat. No. 4,962,933 and U.S. Pat. No. 5,180,168, publication US 2009118028 A1, publication PCT WO2007/009052A1, and Japanese publication JPH022206776, among others.

All these documents aim to solve the problem through external guides in the shape of rulers, set squares, mats or other irregular forms with assembled elements that provide a guide so that the player can execute the correct stroke. These suggested solutions vary from a simple straight ruler, arch or triangular structure to more technologically developed devices. Nonetheless, the disadvantage all these inventions have is that, in all cases, the player has to carry big devices with many pieces that he later has to assemble in situ, which ends up discouraging players from using them.

Other inventions that propose portable guides combined with external guides are, for example, the inventions detailed in U.S. publications US 2009/181787 A1 and US 2011/300962 A1. All these inventions propose flat and straight guides that the player wears in order to limit his movements and therefore learn the correct way to execute a stroke. Publication '787 consists of a device that locks the player's arms in a U shaped form, together with a system of rulers that need to be placed on the ground. Publication '962 is a T shaped guide that aligns the player's shoulders and is connected to the end of the golf club. Both inventions have the same defects that were detailed in the analysis of the previous documents.

Other types of related art that also aim to limit the player's movements are those devices that need to be worn in other parts of the body, such as the elbow (in order to improve swing performance), like in U.S. Pat. No. 5,344,152; the wrist of one hand and the shoulder of the opposite arm creating a bow (also to improve swing performance), like in U.S. Pat. No. 3,740,005; and the player's forearm and elbow, like in Korean publication KR20130100474A. All these devices limit the player's movements, making him uncomfortable to the point that the devices become non-user-friendly. This quickly ends up making the player abandon putting practice.

Finally, another group of inventions focuses on the use of harnesses or belts that together with attached auxiliary devices help correct defective positions or help guide the player into the right shooting direction. These inventions include Japanese publications JP2004229754 and JP2005278830; U.S. patents that describe types of harnesses with elastics or types of belts with ropes staked to the ground or with devices that attach to the golf club, like documents U.S. Pat. No. 5,308,074; U.S. Pat. No. 6,832,960 B2; U.S. Pat. No. 7,731,597 B1; US 2012/0034988 A1; US 2013/0267334 A1 and publication PCT WO 2003/080194A1, which also reveals a chest harness with a removable device that can be attached to the end of the golf club so that the player's movements are limited when he practices his swing. This group of inventions shows structures that not only are tedious to carry and assemble, but also extremely uncomfortable to use, which in the end leads to the player abandoning them.

The purpose of this invention is to provide a portable device for the practice of the putting stroke that is light, small, comfortable, easy to carry and without pieces that need to be assembled before its use.

It is also the purpose of this invention to provide a portable device for the practice of the putting stroke that can be adapted to both right-handed and left-handed players, and with a low production cost.

DETAILED DESCRIPTION OF THE INVENTION

When it comes to putting, there are countless techniques and recommendations. It will depend on each player to adapt them to their particular style or physique, to their habits in relation to standing in front of the ball, to where to place it in relation to their feet, to the chosen type and model of putter, and to multiple other factors.

Either way, the general consensus is that the player must grab the putter's grip delicately but with certainty, without breaking his wrists neither when he grabs the club nor when he executes the shot.

In order for the shot to be precise, the player must be completely still, with his legs and feet planted firmly on the ground, without moving sideways, keeping his hips still and his eyes fixed on the ball, and without making any head movements. He must swing his shoulders backwards and forwards with soft and rhythmic movements, maintaining the speed before, during and after hitting the ball.

Figure 1A:
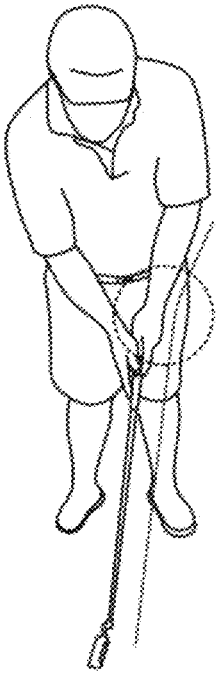
FIGS. 1A and 1B depict a front perspective view of a golf player preparing a putting stroke in a correct and in an incorrect way, respectively.

The way in which the player grabs the putter's grip must be identical to the way he grabs the grips of the other clubs, where the back of the left hand must be aligned with both the forearm and the putter's head, without any kind of wrist flexion, as it can be seen in FIG. 1A.

Figure 1B:
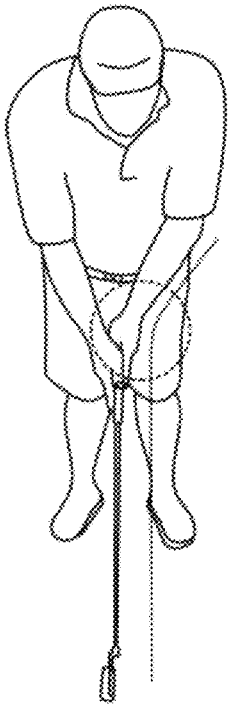

The most common mistake that this invention aims to solve is that right-handed players tend to flex their left wrist when grabbing the putter's grip, whereas left-hand players tend to flex their right wrist, as it is shown in FIG. 1B. This inevitably transforms them into right-handed or left-handed players, respectively, when the correct putting stroke should be backhanded, with the back of the left hand for right-handed players and the back of the right hand for left-handed players.

Figure 2A:
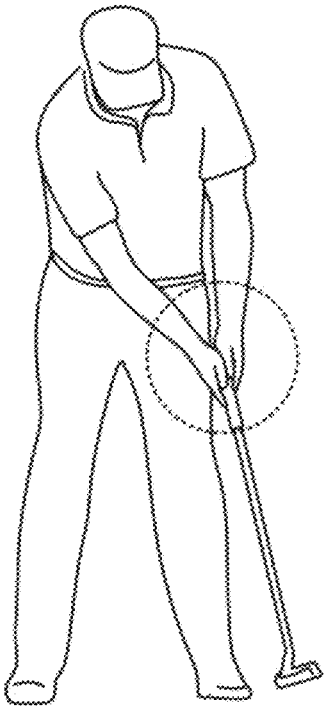
FIGS. 2A and 2B illustrate a front view of a golf player completing a putting stroke in a correct and in an incorrect way, respectively.

The putting stroke will be completed, then, when the back of the left hand, for right-handed players, or the back of the right hand, for left-handed players, has covered a distance of about 4" to 6" from its original resting position, making the external edge of his right and/or left thigh, the ideal point to reach when the correct movement is completed. This is shown in FIG. 2A. Reaching this point when the stroke is completed will make the putter's head stay parallel to the ground, keeping it aligned with the objective (hole), and maintaining the club's speed throughout the shot, without ever slowing down.

Figure 2B:
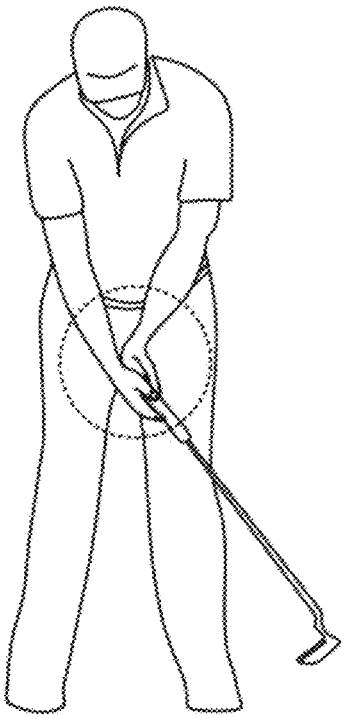
Figure 3:
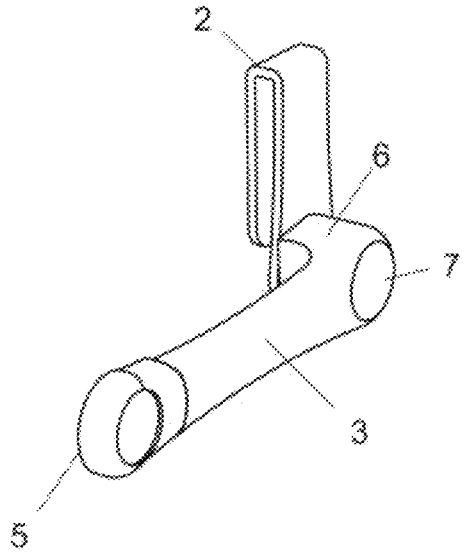
FIG. 3 depicts a top perspective view of the preferred embodiment of the portable guiding device for the practice of golf.
Figure 4:
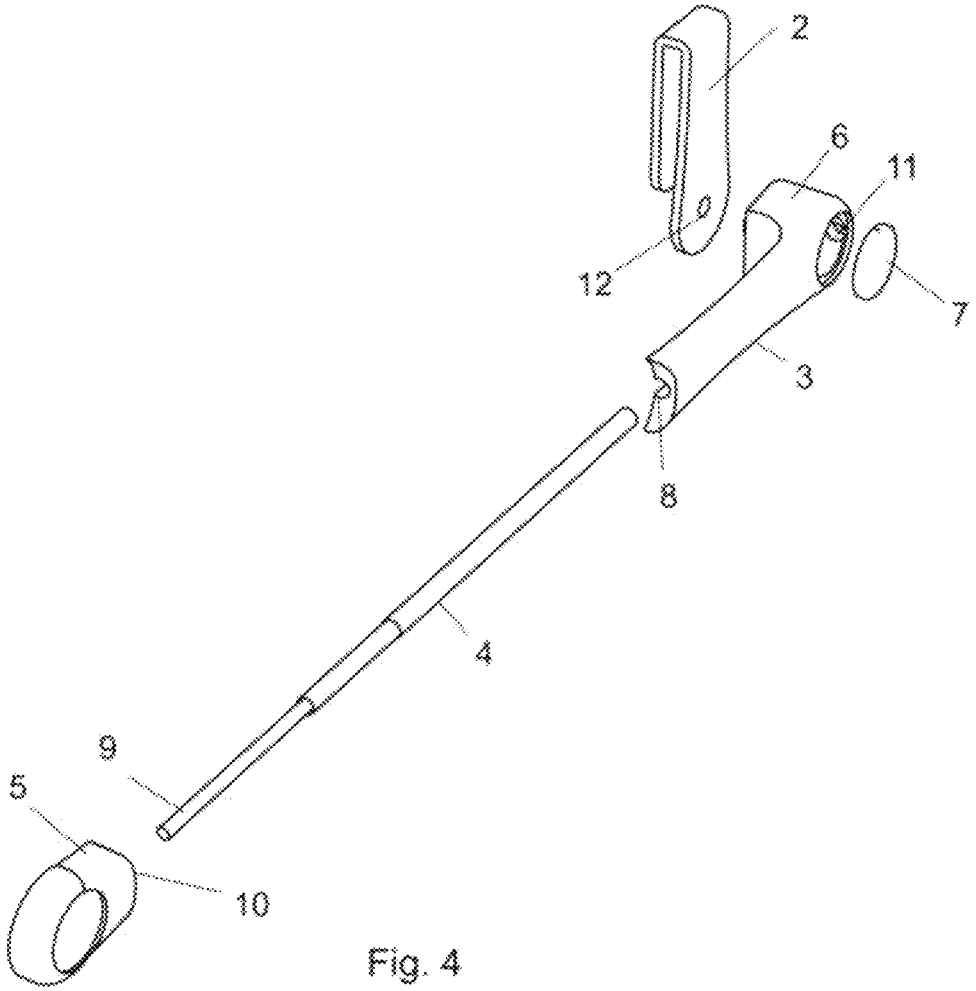
FIG. 4 illustrates an exploded top view of the device in FIG. 3, where each of its elements can be seen separately.
Figure 5:
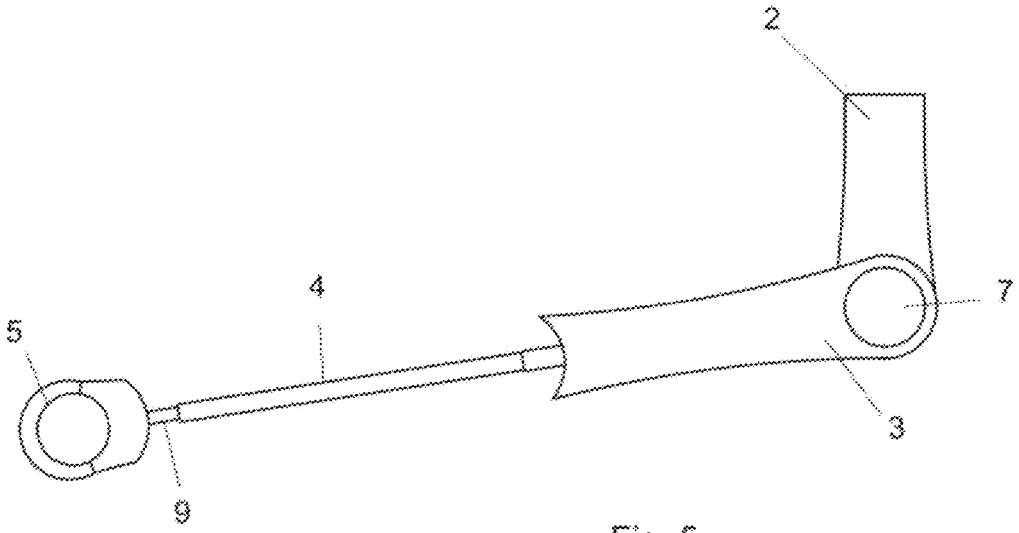
FIG. 5 shows an elevation side view of the preferred embodiment of the portable guiding device for the practice of golf.
Figure 6:
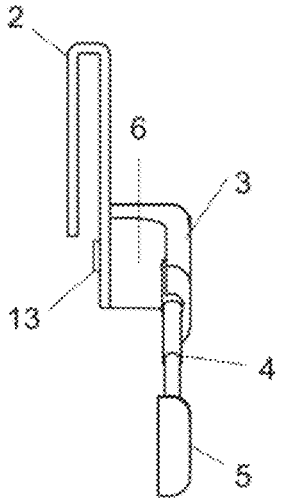
FIG. 6 depicts an elevation front view of the preferred embodiment of the portable guiding device for the practice of golf.

An inadequate way of grabbing the putter's grip or an incorrect execution of the putting stroke will invariably lead to the opening or closing of the club's face at the moment of impact, as it can be seen in FIG. 2B. This will result in an unwilling deviation of the ball's trajectory, a deficiency in the rolling of the ball and a fault in ball strength and ball distance, which will ultimately lead to a poor final result in the direction and/or strength of the stroke.

Through the use of this invention's device, the above-mentioned common putting stroke mistakes will be avoided and/or fixed. Those mistakes include: the swinging or sideways body movement at the time of executing the shot, sudden deceleration which leads to the opening or closing of the putter's face at the moment of impact, the prevailing shot with the left or right hand, and the movement of the head.

Figure 7:
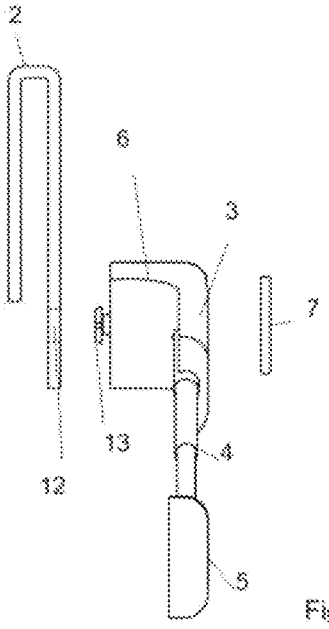
FIG. 7 depicts an exploded elevation front view of the preferred way to assemble the device shown in FIG. 6.

The preferred embodiment of the portable guiding device for the practice of golf (1) consists of a first fastening module (2) rigid or semi-rigid, with an inverted U shape, which is attached to the user's belt. Said module (2) may be of different materials such as aluminum, plastic, rubber, acrylic or others, and is connected to an L-shaped second arm module (3), which consists of short section (6) and an elbow joint with a circular lid (7). All the elements are joined by a button (13) that is projected from the inner face of the module (3), which is inserted in an orifice (12) of the first module (2) by means of pressure, as it is shown in FIG. 7, where an exploded view of the elements and the way they can be linked has been illustrated.

Said second arm module (3), which allows for different adjustment and angle degree variations, consists of a retractable extendible system (4), that is placed in the mouth (8) of the module (3). This retractable arm (4), in turn, consists of a series of telescopic sub-arms that may be manually extended or retracted, depending on the user's needs, and concludes in a distal end (9), which is placed in the mouth (10) of a third objective module (5). Said objective module (5) has an irregular trapezoid shape, and consists of a smooth inner side and a soft dome-shaped outer side, and can be made of a soft material such as rubber, latex, velcro, foam rubber or any similar material.

Figure 7A:
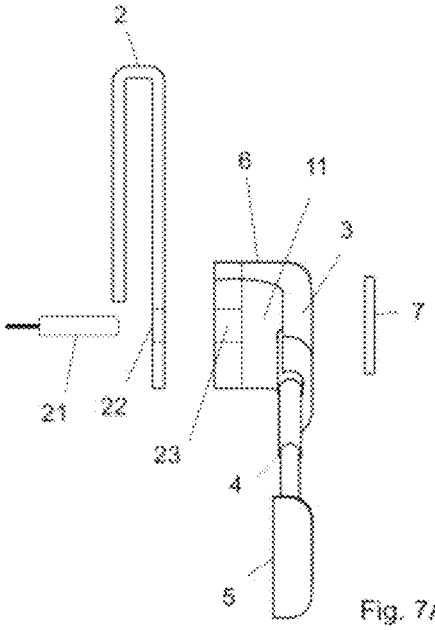
FIGS. 7A to 7G are exploded elevation front views that show the different ways in which the portable guiding device for the practice of golf can be assembled.
Figure 7B:
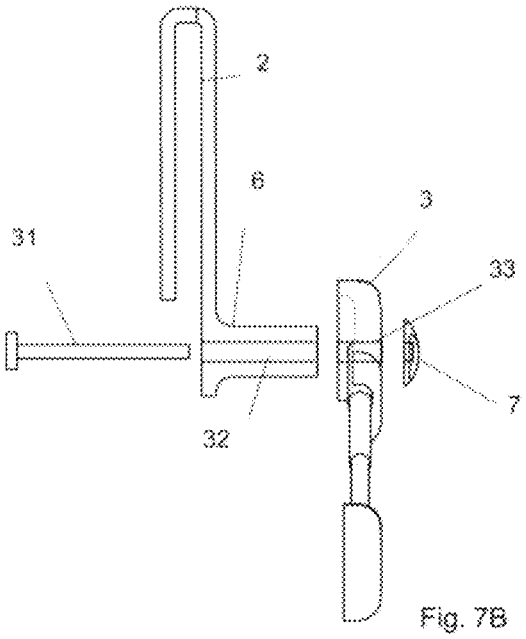
Figure 7C:
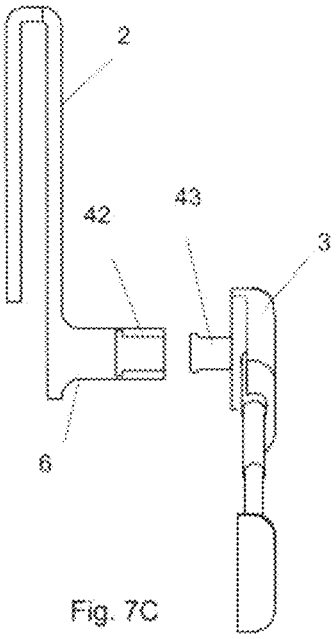
Figure 7D:
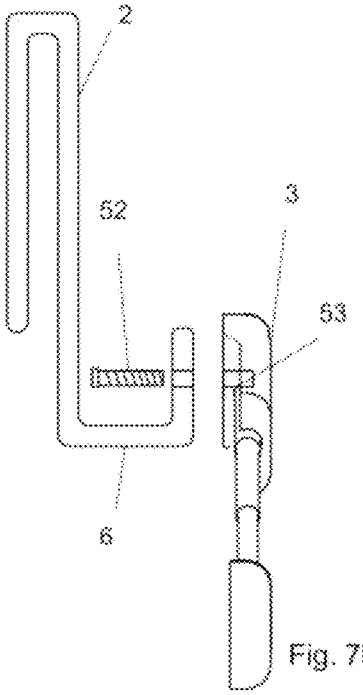
Figure 7E:
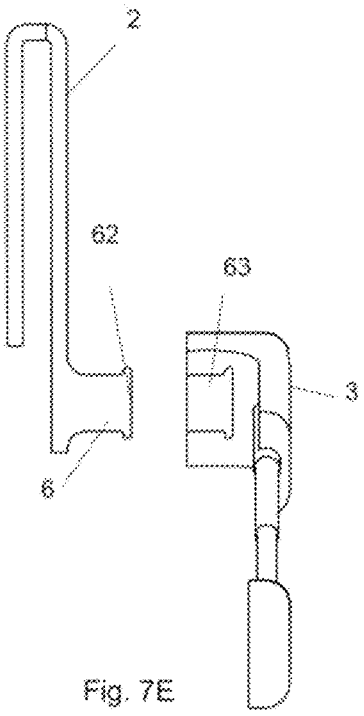
Figure 7F:
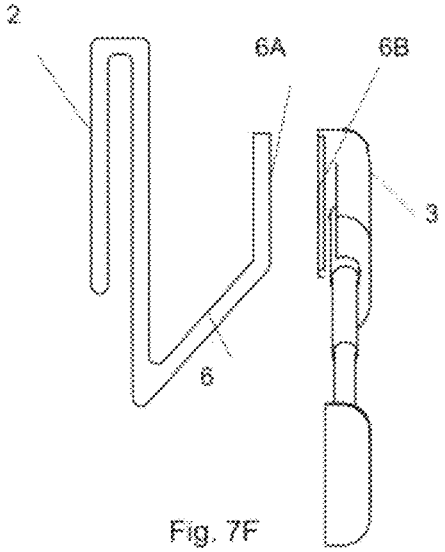
Figure 7G:
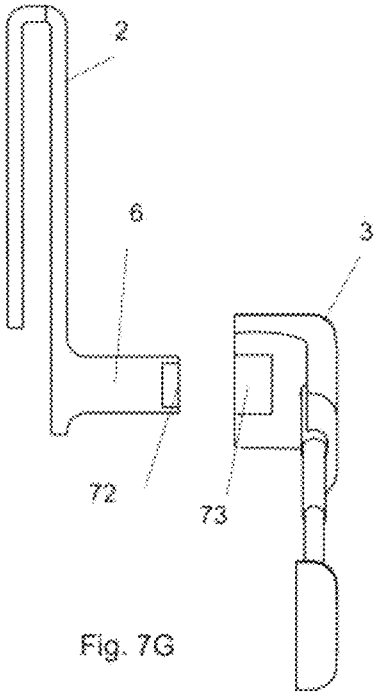

There are different methods to attach the fastening module (2) and the arm module (3); like the one shown in the cutaway view from FIG. 7A, for example. In this attachment by rivet method, the fastening module (2) comprises an opening (22) and the arm module (3) contains a through-channel (23), through which the rivet (21) is introduced, and the rivet will butt with the end of the through-channel (23), without invading the adjacent hollow chamber (11) from the short section (6), as the internal end of the retracting arm (4) will be placed there during its resting position. Another alternative attachment method is illustrated in the cutaway view from FIG. 7B, wherein the connecting cylinder (6) comprises a through-channel (32) through which a screw (31) is inserted, and the screw will penetrate in the through-channel (33) of the arm module (3) until it reaches a final thread of the lid (7), which closes the anchorage. Another attachment method comprises a wide-mouth coupling (43) that is projected from the arm module (3) and attached to the opening (42) of the module (2), as it is shown in FIG. 7C; or a wide-mouth coupling (62) that is projected from the module (2) and inserted into the opening (63) of the module (3), as it is shown in FIG. 7E. Another attachment method, as shown in FIG. 7D, is when the connecting cylinder (6) of the fastening module (2) has an "L" shape, which comprises a through-hole that coincides with the channel (53) of the module (3), and through which a screw (52) is tightened. Another attachment method is when the fastening module (2) consists of a metallic connecting arm (6) placed diagonally to the vertical walls of the module, which are later attached to the user's belt, and it concludes with vertical section (6A) that faces a magnet (6B), that is attached to the flat surface of the arm module (3), as it is shown in FIG. 7F. Finally, an additional attachment method is shown in FIG. 7G, wherein the connecting cylinder (6) consists of an open mouth (72) that is inserted into the cavity (73) that is located in the center of the flat side of the arm module (3).

The particular configuration of the portable guiding device for the practice of golf makes it easy to use and carry, due to the fact that it weights very little and its small size facilitates its transportation and handling. What is more, the device can be adapted for either right-handed or left-handed players and it has a very low production cost given that only a small amount of pieces are needed for its assembling.

Figure 8A:
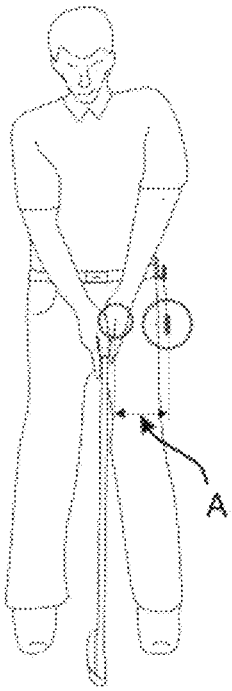
FIGS. 8A and 8B are elevation front views that represent a sequence of use of the portable guiding device for the practice of golf.

The player will be able to use the preferred embodiment of the claimed device by placing the vertical section of the fastening module (2) on the top border of his belt and sliding it into the preferred spot, so that he can later manipulate the arm module (3), and extract the retractable extendible system, whose arm (4) may measure from 10" to 12" when it is completely extended. Finally, he will place the device in the necessary angle so that the objective module (5) is at the same level of the player's hands, as it is shown in FIG. 8A, where the desired distance (A) between the back of the left hand and the objective module (5) should be of about 4-6" when the player is in a resting position, just before executing the putting stroke.

Figure 8B:
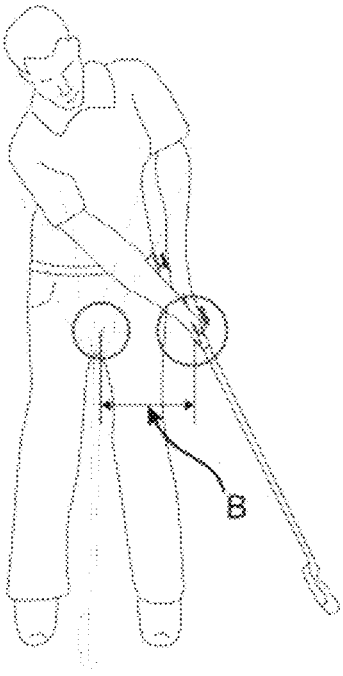

Once prepared, the player must execute the stroke maintaining both hands on the same horizontal axis, surpassing the external left thigh edge theoretical limit, until making contact with the objective module (5), as it is shown in FIG. 8B, where the distance (B) will vary depending on the details of the stroke to be executed; for example, the speed of the green, the characteristics and distance to be covered depending on the height of the green, etc. Nonetheless, in order to have a fast green it is ideal that the distance (B) does not surpasses a maximum of 8" counted from the axis of the resting position. That is to say, the objective module (5) shall move no more than 2", as from its contact with the back of the left hand of the player.

Figure 9A:
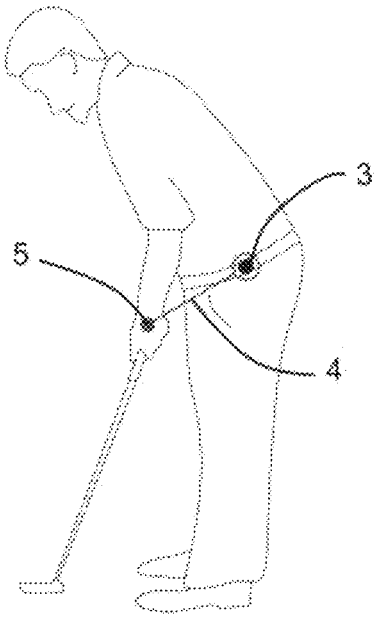
FIGS. 9A and 9B are elevation side views that show the use of the portable guiding device for the practice of golf.

This way, when the player executes the stroke he will have both a visual and tactile objective that will help him maintain a constant speed of the club throughout the stroke, without stopping or slowing down, and it will allow him to always maintain the face of the club parallel to the ground and aligned with the hole, as it is shown in FIG. 9A.

The player, by having an objective (5) surface both visual and tactile that he will need to reach with the back of his hand at the moment of impact with the ball, will have a real sensation of passing on his hands in each of the putting strokes during practice. This constitutes a permanent correction element that brings about substantial improvements in the game and in the putting scores achieved.

This invention's device, by being lightweigthed, portable and easy to put on and remove, will turn putting practice more attractive and easy for players. Nowadays, this practice is being abandoned due to the fact that the prior devices have failed to provide a friendly device for users.

Figure 9B:
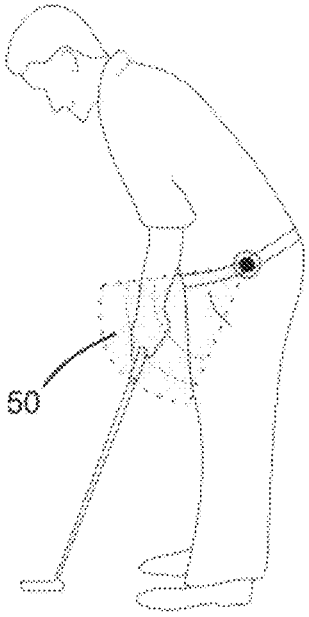
Figure 10:
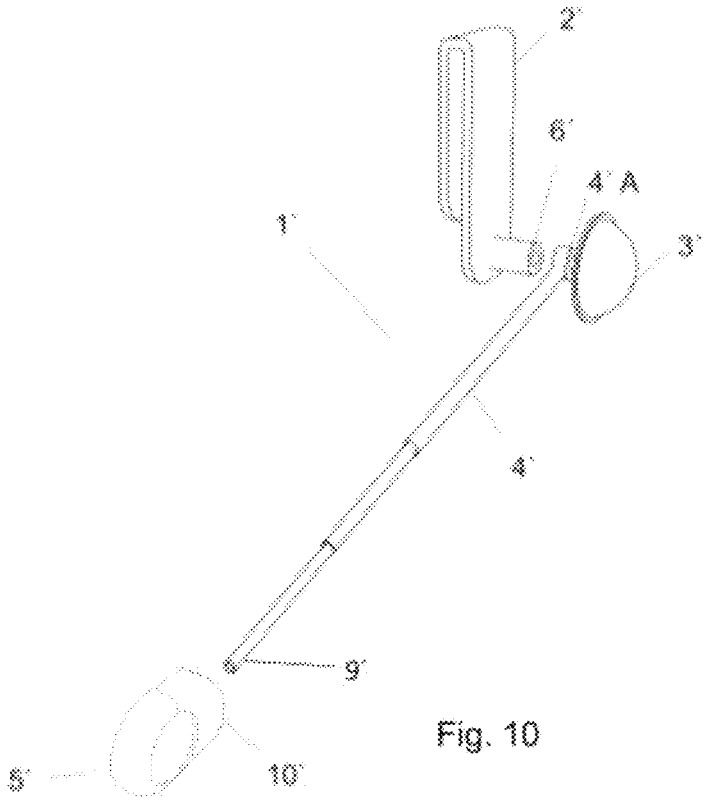
FIG. 10 illustrates a top perspective view of a second embodiment of the portable guiding device for the practice of golf.
Figure 11:
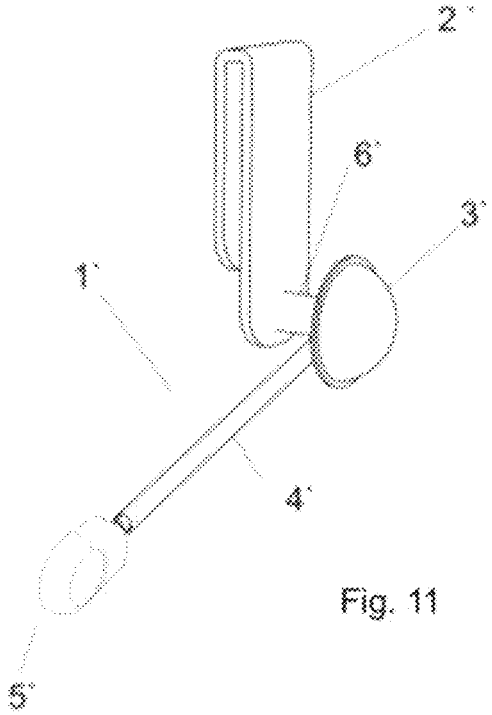
FIG. 11 depicts an exploded top view of the second embodiment from FIG. 10, where each of its elements can be seen separately.
Figure 12:
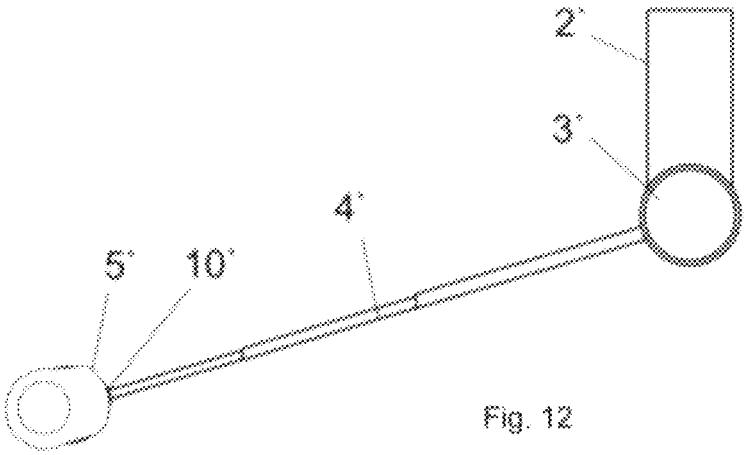
FIG. 12 shows an elevation side view of the second embodiment of the portable guiding device for the practice of golf.
Figure 13:
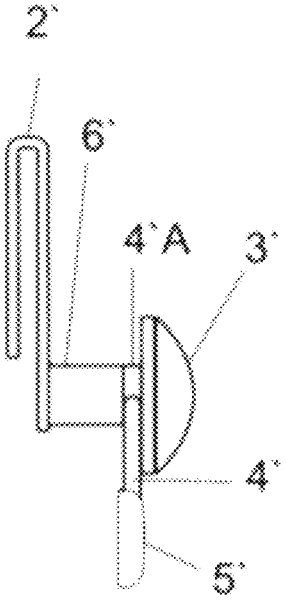
FIG. 13 depicts an elevation front view of the second embodiment of the portable guiding device for the practice of golf.

FIG. 9B shows how a player will be able to regulate and adjust the claimed device according to his comfort, setting an influence zone (50) where the retractable arm (4) can be placed depending on the player's anthropometric measurements.

FIGS. 10 to 14 show a second embodiment of the portable guiding device for the practice of golf, which consists of a first rigid or semi-rigid module (2') with an inverted U shape, which is attached to the user's belt. Said module (2'), which may be of different materials such as aluminum, plastic, rubber, acrylic or others, consists of a connector (6') in the shape of a hollow cylinder that is attached to a second module (3'), which has a circular base and a dome shape. Between modules (2') and (3') there is a pivoting arm (4') that allows for different adjustment and angle degree variations. This pivoting arm (4') consists of a retractable extendible system made of a series of telescopic sub-arms that may be manually extended or retracted, depending on the user's needs and it concludes in a male distal end that is placed in a female mouth (10') of an objective module (5'). Said objective module (5') has a circular shape and consists of a smooth inner side and a soft dome-shaped outer side, and can be made of a soft material such as rubber, latex, velcro, foam rubber or any similar material.

Figure 14:
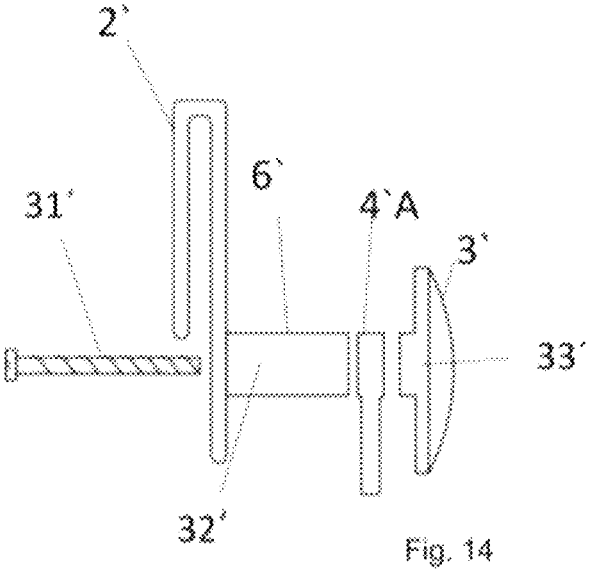
FIG. 14 depicts an exploded elevation front view of the preferred way to assemble the device in FIG. 10.
Figure 15:
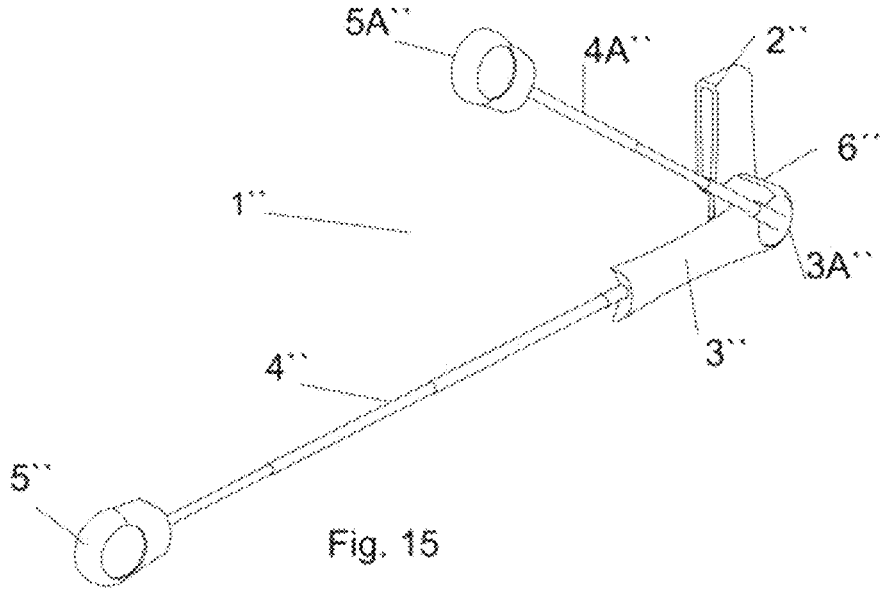
FIG. 15 illustrates a top perspective view of a third embodiment of the portable guiding device for the practice of golf.

All the elements are joined by a screw (31'), that is placed in the through-channel (32') of the connector (6') and goes through the hollow head (4'A) of the pivoting arm (4') and the through-channel (33') of the second module (3'), as it is shown in FIG. 14.

In this second embodiment, the extendible arm (4') pivots freely between modules (2') and (3'); in the preferred embodiment, on the other hand, the extendible arm (4) is projected directly from the module (3), which the user needs to spin and adjust as desired.

Figure 16:
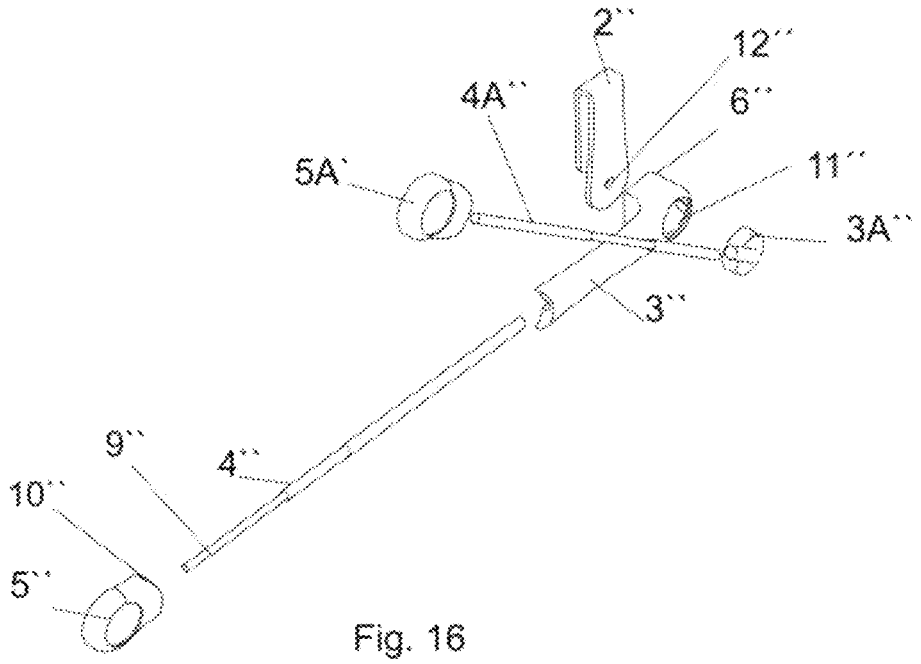
FIG. 16 depicts an exploded top view of the third embodiment from FIG. 15, where each of its elements can be seen separately.
Figure 17:
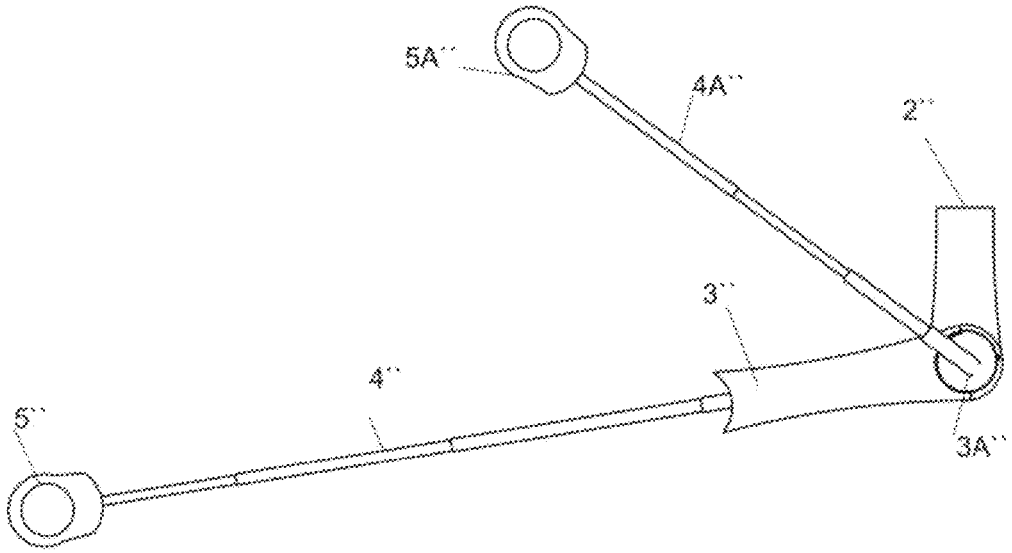
FIG. 17 shows an elevation side view of the third embodiment of the portable guiding device for the practice of golf.
Figure 18:
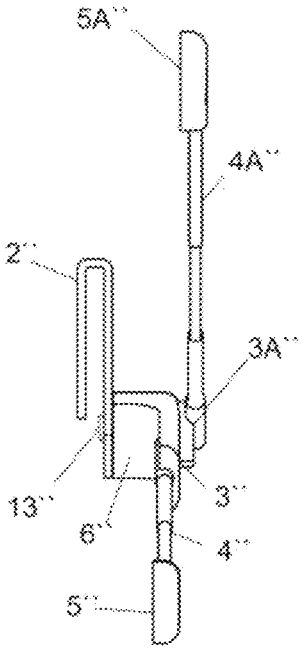
FIG. 18 depicts an elevation front view of the third embodiment of the portable guiding device for the practice of golf.

A third embodiment, in which a second objective module is added, is illustrated in FIGS. 15 through 19B. This embodiment maintains the basic structure of the preferred embodiment and consists of a first fastening module (2"), rigid or semi-rigid, with an inverted U shape, which is attached to the user's belt, and connected to a second L-shaped arm module (3"), which consists of short section (6") and an elbow joint with a circular lid (3A"). Said second arm module (3") is a pivoting arm, which is formed by a series of telescopic sub-arms that may be manually extended or retracted, depending on the user's needs, and concludes in a distal male end (9") which is placed in the female mouth (10") of a third objective module (5"), identical in shape to the one from the preferred embodiment. All the elements are joined in the same way as in the preferred embodiment, as it is show in FIG. 7, but this time the attachment button (13") is inserted into the opening (12") of the fastening module (2) by means of pressure. FIG. 18 shows the frontal view of the device (1") fully assembled, in its operating function. FIG. 16, on the contrary, shows an exploded view of the portable guiding device for the practice of golf (1") with each of its parts and the way to assemble the device. When the retracting arm (4") is in its resting position, its internal end rests inside the chamber (11") which defines the hollow interior of the short arm (6").

The difference contributed by this third embodiment lies in the fact that the arm module (3") consists of a second retracting pivoting arm (4*a*") shorter than the first one and in that it also concludes in a circular-shaped second objective module (5A"). Said second pivoting arm (4A") is removable and can be inserted in a female connector that is projected from the lid (3A") of the second module (3").

This third embodiment's particular configuration allows the user to have two objective modules instead of one. The first objective module's (5") will butt with the back of the user's left hand, while the second objective module (5A") will butt with the user's left elbow.

Figure 19A:
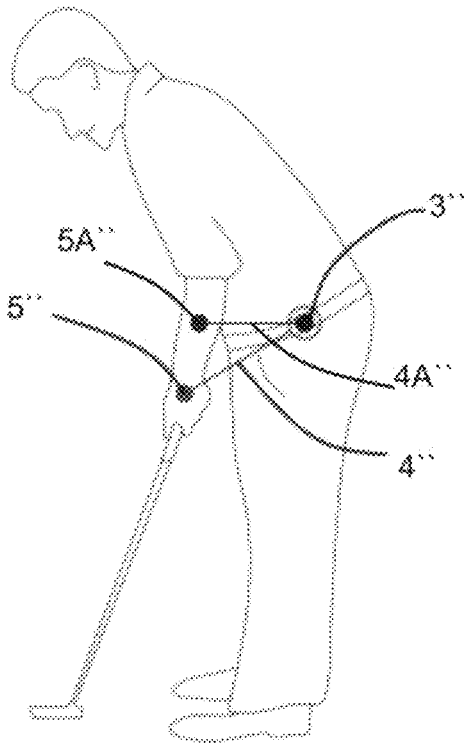
FIGS. 19A and 19B are elevation side views that show the use of the third embodiment of the portable guiding device for the practice of golf.

This way, when the player executes the stroke he will have both a visual and tactile objective that will help him maintain a constant speed of the club throughout the stroke, without stopping or slowing down, and it will allow him to always maintain the face of the club parallel to the ground and aligned with the hole, as it is shown in FIG. 19A.

Figure 19B:
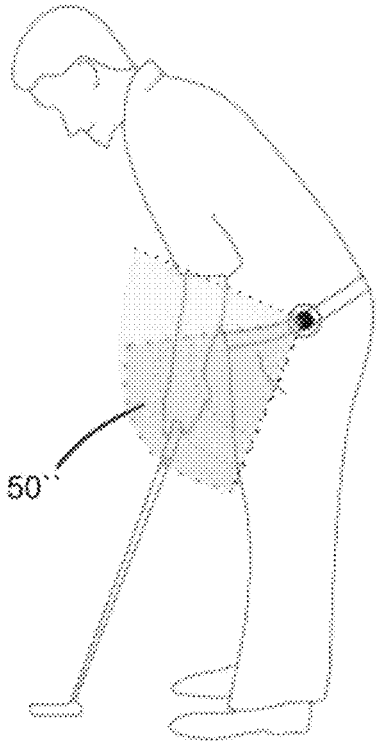

FIG. 19B shows how a player will be able to regulate and adjust the claimed device according to his comfort, setting an influence zone (50") wherein both the retractable arm (4") and the second pivoting arm (4A") can be placed depending on the player's anthropometric measurements.

This third embodiment, which comprises two objective modules that the player will need to reach with the back of his hand or his elbow at the moment of impact with the ball, will give the player a real sensation of passing on his hands and arms in each of the putting strokes during practice. This constitutes an even stricter correction element than the ones provided by the previous embodiments, where the user's hand is the only restrictive limit.

A fourth embodiment is shown in FIGS. 20 to 22A. This alternative embodiment is electronic and consists of a portable guiding device for the practice of golf that has two clearly defined modules: the transmitter module (101) and the terminal receiver module (102). The transmitter module (101) consists of a fastening piece (103), rigid or semi-rigid, with an inverted U shape, which is attached to the user's belt and may be of different materials such as aluminum, plastic, rubber, acrylic or others. A hollow cylinder (104) of limited length is projected from that fastening piece (103). The inside of the cylinder consists of a battery-operated mechanism that emits an infrared light through a pointer (106), and the cylinder (104) concludes in a battery lid (105). The receiver module (102), which has the shape of a bracelet, consists of a vibration area (107) on one side, and a camera (108) with a lid on the opposite side, where the battery that powers that bracelet (102) is located.

The operation of this electronic embodiment is equivalent to the previous mechanical methods. In this method, the limit that guides the player's stroke is virtual, as opposed to the tangible limits used in the previous methods.

Both modules (101) and (102) are composed of active and passive sensors, so that multiple configurations are allowed. A collimated beam of infrared light is preferably used to generate the objective zone (150).

In the embodiment shown in FIGS. 20 to 22A, both the transmitter (101) module and the terminal receiver module (102) are active, which is the reason why the design of the electronic components is divided in two parts, one in each module. If the terminal receiver module were passive and would reflect the signal to the transmitter/receiver module, both components parts will be in the transmitter module.

Figure 20:
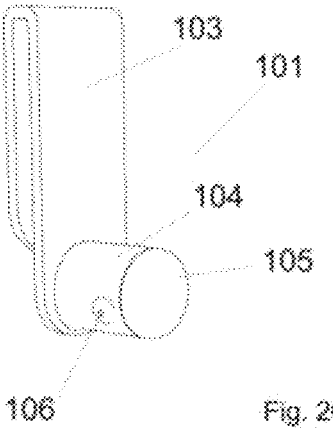
FIGS. 20 and 20A show top views of a fourth embodiment of the portable guiding device for the practice of golf, which consists of two electronic modules: a transmitter and a receiver.
Figure 20A:
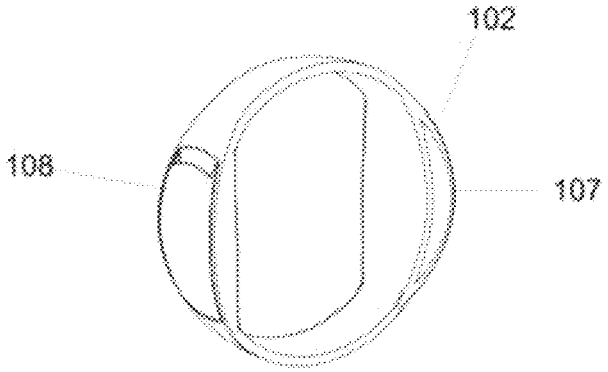

The transmitter module (101) shown in FIG. 20 is preferably composed of a processor (MCU) that controls the device, a Bluetooth (BLE) module (to, for example, connect to other smart devices and provide statistical information to the user about his strokes), the transmitter itself and a battery to power the system. The receiver module (102) shown in FIG. 20A consists of, preferably, a receiver sensor or photosensitive material, a filter to process the signal and detect when the module is in the objective zone (150), an actuator or engine to generate the vibration, and a battery to power the whole module.

In other embodiments, the objective zone can be generated through ultrasound, laser or any other type of transmitter that has similar effects. The transmitter module of the light source that generates the objective zone faces a terminal receiver module, that may be active or passive. If passive, it may be a simple reflecting surface that acts as a mirror of the transmitter system. In this method (not drawn), the module is a receiver and the only active component. When the components are aligned, the transmitter module detects the reflected signal by using photosensitive material and notifies the user through a soft vibration. This vibration may be generated with an electrical engine with an unbalanced mass, mounted on the main rotation axis. In other embodiment alternatives, solenoids or any other actuator capable of generating such movement may be used.

Figure 21:
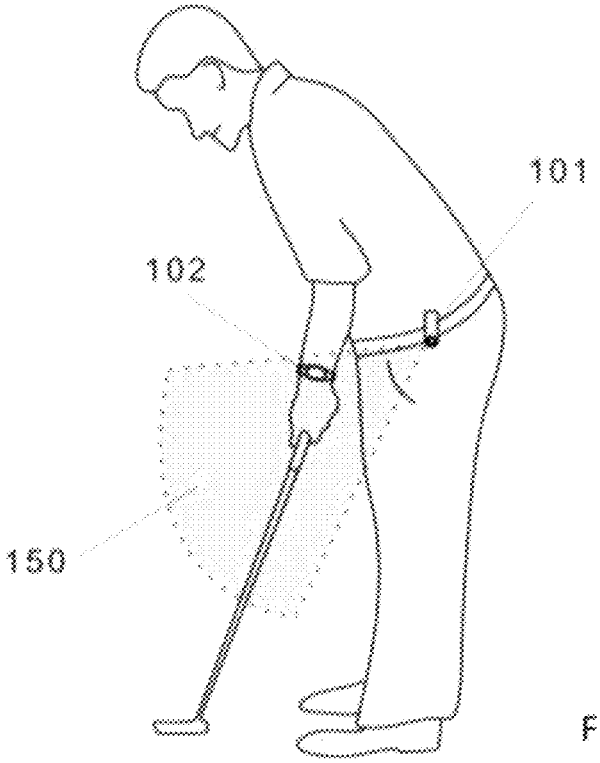
FIG. 21 is an elevation side view that shows the use of the fourth embodiment of the portable guiding device for the practice of golf.
Figure 22:
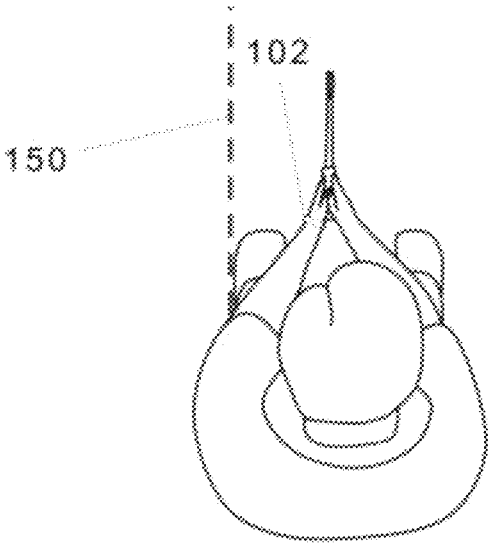
FIGS. 22 and 22A are plan views that represent a sequence of use of the fourth embodiment of the portable guiding device for the practice of golf.

As it is shown in the side view in FIG. 21 and in the plan view in FIG. 22, the player prepares to execute the putting stroke completely still, with his legs and feet planted firmly on the ground, without moving sideways, keeping his eyes fixed on the ball, and without moving his head, while he aligns the back of his left hand, where he is wearing the receiver bracelet (102), with his forearm and with the putter's head, without any type of wrist flexion. Before that, he must have placed the transmitter module (101) on his belt, slidden it and adjusted it so that the beam of infrared light (150) that the pointer (106) emits is parallel to the golf club.

Figure 22A:
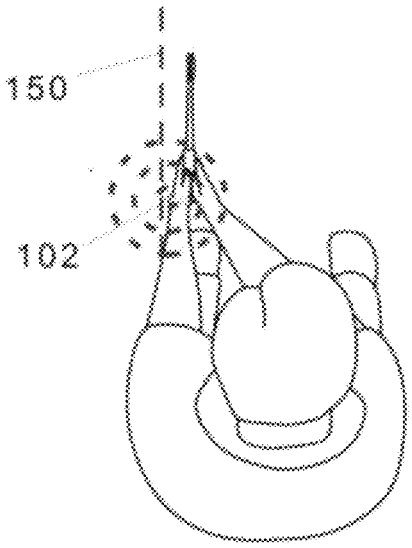

Once prepared, the player will execute the stroke with both hands on the same horizontal axis while maintaining the club parallel to the line (150) of the beam of light, as it is shown in FIG. 22A. The moment the player surpasses the external left thigh edge theoretical limit, which coincides with the line (150) of the beam of light, the bracelet's (102) reader (107) will start vibrating, indicating the player that he has reached the desired virtual limit. If the player wishes to obtain the desired results in the putting stroke, that line must not be surpassed by much. This virtual limit, which is the result of the crossing between the bracelet (102) and the beam of infrared light (150), is replacing, in this electronic embodiment, the tangible limit of the objective module (5, 5', 5", 5A") of the mechanical embodiments illustrated in FIGS. 1 to 19B.

The use of the claimed device in any of its embodiments will most definitely result in a real improvement in the user's green game, which will encourage players, either amateurs or professionals willing to improve, and fill them with excitement for continuing with putting practice. The advantages of this invention, in relation to the prior art which tried to solve the same technical problem in the past, lie on its particular configuration, already described and illustrated. This configuration gives the device certain characteristics that make it easy to use and carry, adaptable to both right-handed and left-handed players, and it has a very low production cost due to the design requiring only a few pieces. Its minimum weight and small size make it possible for the user to carry it in his pocket or even in the golf bags they usually carry. All this will encourage its user to use the device on an everyday basis.

This description must be interpreted as a mere illustration of the basic principles of the invention. Thus, the invention must not be limited to the exact reproduction of its structures as they are shown and described, making it possible to effect changes, modifications, and adaptations, within the scope of the invention.

Therefore, it is clear that modifications to the design and configuration of the described device may be effected, such as optimal dimensional relationships between the parts of the invention, variations in size, material, shape, function, way of operation, assembly, use and other variants that one skilled in the art may contribute, always within the scope of this invention, which is clearly determined by the following claims.

The invention claimed is:

1. Portable guiding device for the practice of golf, comprising a first fastening module with an inverted U shape, which is attachable to a user's belt and connected to an L-shaped second arm module from which an extendible and pivoting arm is extractable, which in turn comprises a series of retractable sections, with a last one of said retractable sections concluding in a third objective module of soft material, wherein said L-shaped second arm module comprises a short section and an elbow joint with a circular lid, said third objective module, in use, being positioned to limit a user's putting stroke, wherein said L-shaped second arm module comprises an inner face wherefrom an attachment button that is insertable into an opening of the first fastening module is projected.

2. Portable guiding device for the practice of golf, as claimed in claim 1, wherein said extendible and pivoting arm comprises a retractable extendible system that is placed on a mouth of the L-shaped second arm module.

3. Portable guiding device for the practice of golf, as claimed in claim 1, wherein said first fastening module comprises an opening and the L-shaped second arm module comprises a through-channel, through which a rivet is introduced in order to connect said first and second modules.

* * * * *